US009642424B1

(12) United States Patent
Holmes

(10) Patent No.: US 9,642,424 B1
(45) Date of Patent: May 9, 2017

(54) SUITCASE WITH FOLDABLE SEAT

(71) Applicant: Baron Holmes, Bronx, NY (US)

(72) Inventor: Baron Holmes, Bronx, NY (US)

( * ) Notice: Subject to any disclaimer, the term of this patent is extended or adjusted under 35 U.S.C. 154(b) by 0 days.

(21) Appl. No.: 15/150,189

(22) Filed: May 9, 2016

(51) Int. Cl.
*A45C 9/00* (2006.01)
*A45C 5/03* (2006.01)

(52) U.S. Cl.
CPC ..... *A45C 9/00* (2013.01); *A45C 5/03* (2013.01); *A45C 2009/002* (2013.01)

(58) Field of Classification Search
CPC ..... A45C 9/00; A45C 5/03; A45C 2009/002
See application file for complete search history.

(56) References Cited

U.S. PATENT DOCUMENTS 2,922,465 A * 1/1960 Johansson ..... A45F 4/02 224/155
3,315,856 A * 4/1967 Black ..... A45F 4/02 224/155
5,374,073 A * 12/1994 Hung-Hsin ..... A45C 5/14 16/113.1
5,507,508 A * 4/1996 Liang ..... A45C 5/14 190/18 A
5,957,349 A * 9/1999 Krulik ..... A45C 9/00 190/8
6,048,023 A * 4/2000 Lampton ..... A45C 15/00 297/129
D438,719 S * 3/2001 Ford, Jr. ..... D6/336
D459,883 S * 7/2002 Worrell ..... A45C 9/00 D3/274
6,932,427 B2 * 8/2005 Tamura ..... A45C 15/00 190/12 A
6,997,507 B2 * 2/2006 Rhee ..... A47C 4/48 224/153
7,097,017 B1 8/2006 LaCrosse et al.
7,213,692 B2 * 5/2007 Wang ..... A45C 9/00 190/8
7,757,912 B1 * 7/2010 Fabro ..... A45F 4/02 224/153
7,987,955 B2 * 8/2011 Puchalski ..... A45C 5/14 190/10
D685,584 S * 7/2013 Ammann, Jr. ..... D6/336
9,332,852 B1 * 5/2016 Milich ..... A47C 13/00
2008/0217129 A1 * 9/2008 Whelan ..... A45C 9/00 190/8
2009/0308706 A1 * 12/2009 Mao ..... A45C 5/14 190/8
2011/0162931 A1 * 7/2011 Collins ..... A45C 5/14 190/8

* cited by examiner

*Primary Examiner* — Tri Mai
(74) *Attorney, Agent, or Firm* — Stevenson IP, LLC

(57) ABSTRACT

A suitcase with foldable seat including a suitcase and each of a right inner leg and a left inner leg of a pair of inner legs coupled to a back side of the suitcase. A front end of each a right support member and a left support member of a pair of horizontal support members is pivotally attached to each of the right inner leg and the left inner leg, respectively, and a rear end of each of the right support member and the left support member is pivotally attached to each of a right outer leg and a left outer leg, respectively, of a pair of outer legs. A seat covering is continuously disposed between each of the pair of inner legs and the pair of outer legs. The pair of outer legs is foldable between a retracted position and an alternate extended position.

3 Claims, 5 Drawing Sheets

SUITCASE WITH FOLDABLE SEAT

BACKGROUND OF THE INVENTION

Various types of suitcases are known in the prior art. However, what has been needed is a suitcase with foldable seat including a suitcase and each of a right inner leg and a left inner leg of a pair of inner legs coupled to a back side of the suitcase. What has been further needed is for a front end of each a right support member and a left support member of a pair of horizontal support members to be pivotally attached to each of the right inner leg and the left inner leg, respectively, and a rear end of each of the right support member and the left support member to be pivotally attached to each of a right outer leg and a left outer leg, respectively, of a pair of outer legs. Lastly, what has been needed is for a seat covering to be continuously disposed between each of the pair of inner legs and the pair of outer legs. The pair of outer legs is foldable between a retracted position and an alternate extended position. The suitcase with foldable seat thus provides travelers with a place to sit while waiting for a plane, train, or bus when other seating options are unavailable. Furthermore, the retractability of the pair of outer legs ensures that the seat covering remains folded and unobtrusive when not in use.

FIELD OF THE INVENTION

The present invention relates to suitcases, and more particularly, to a suitcase with foldable seat.

SUMMARY OF THE INVENTION

The general purpose of the present suitcase with foldable seat, described subsequently in greater detail, is to provide a suitcase with foldable seat which has many novel features that result in a suitcase with foldable seat which is not anticipated, rendered obvious, suggested, or even implied by prior art, either alone or in combination thereof.

To accomplish this, the present suitcase with foldable seat includes a suitcase having a front side, a back side, a right side, a left side, a top side, and a bottom side. Each of a right inner leg and a left inner leg of a pair of inner legs has a bottom end and a top end. The right inner leg is coupled to the back side of the suitcase proximal the right side, and the left inner leg is coupled to the back side of the suitcase proximal the left side. A right outer leg and a left outer leg of a pair of outer legs has a bottom area and a top area. Each of a right support member and a left support member of a pair of horizontal support members has a front end, a rear end, and a pivotable connection point medially disposed between the front end and the rear end. The front end of each of the right support member and the left support member is pivotally attached to each of the right inner leg and the left inner leg, respectively, proximal the top end. The rear end of each of the right support member and the left support member is pivotally attached to each of the right outer leg and the left outer leg, respectively, proximal the top area.

The suitcase with foldable seat further includes a single continuous rectangular flexible seat covering having a right front corner, a left front corner, a right rear corner, and a left rear corner. The right front corner is disposed on the top end of the right inner leg, the left front corner is disposed on the top end of the left inner leg, the right rear corner is disposed on the top area of the right outer leg, and the left rear corner is disposed on the top area of the left outer leg. A length of each of the pair of inner legs and each of the pair of outer legs substantially conforms to a height of the suitcase. The pair of outer legs is foldable between a retracted position and an alternate extended position. The pair of outer legs is in the retracted position when the pair of outer legs is disposed immediately adjacent to the pair of inner legs, and the pair of outer legs is in the extended position when the pair of outer legs is extended away from the suitcase. The seat covering is optionally a mesh material and, alternately, leather, for comfort and durability.

Thus has been broadly outlined the more important features of the present suitcase with foldable seat so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
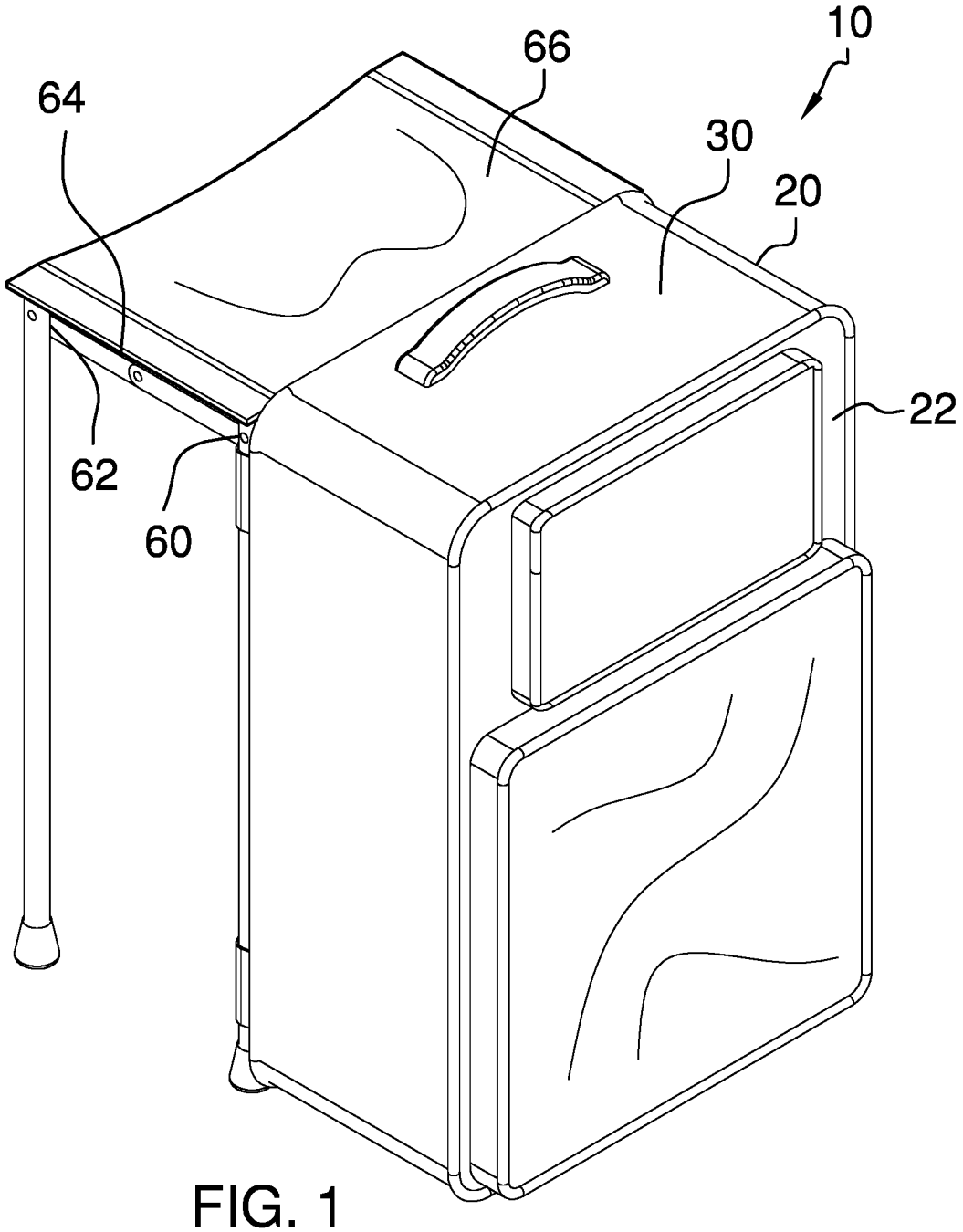
FIG. 1 is a front isometric view.
Figure 2:
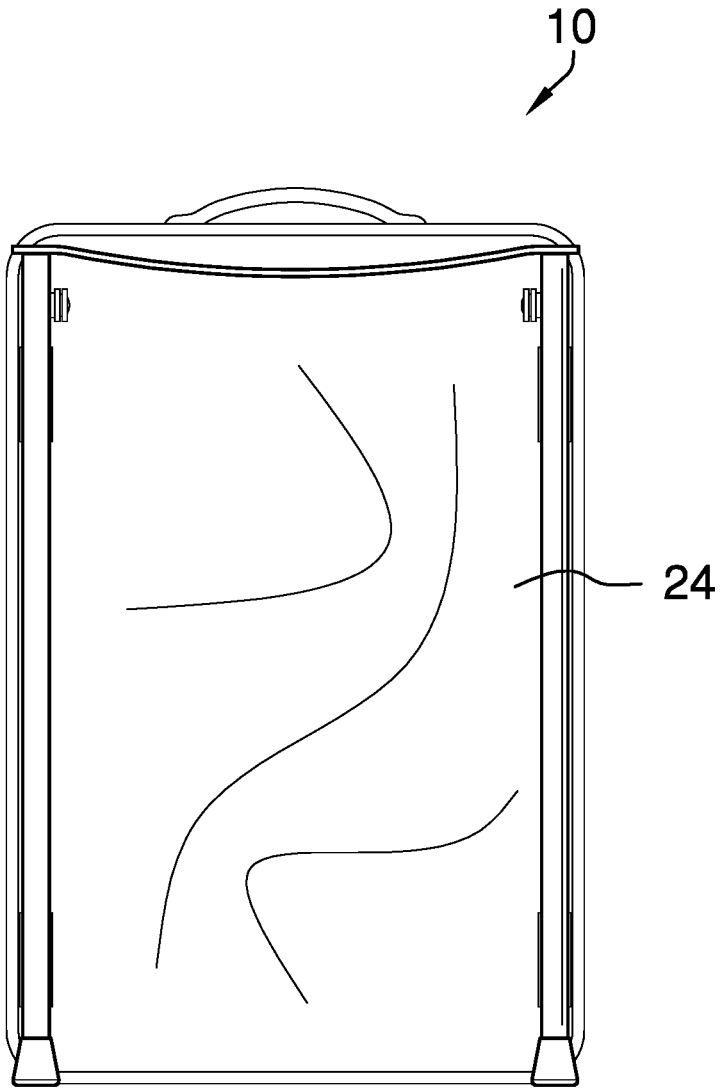
FIG. 2 is a rear elevation view.
Figure 3:
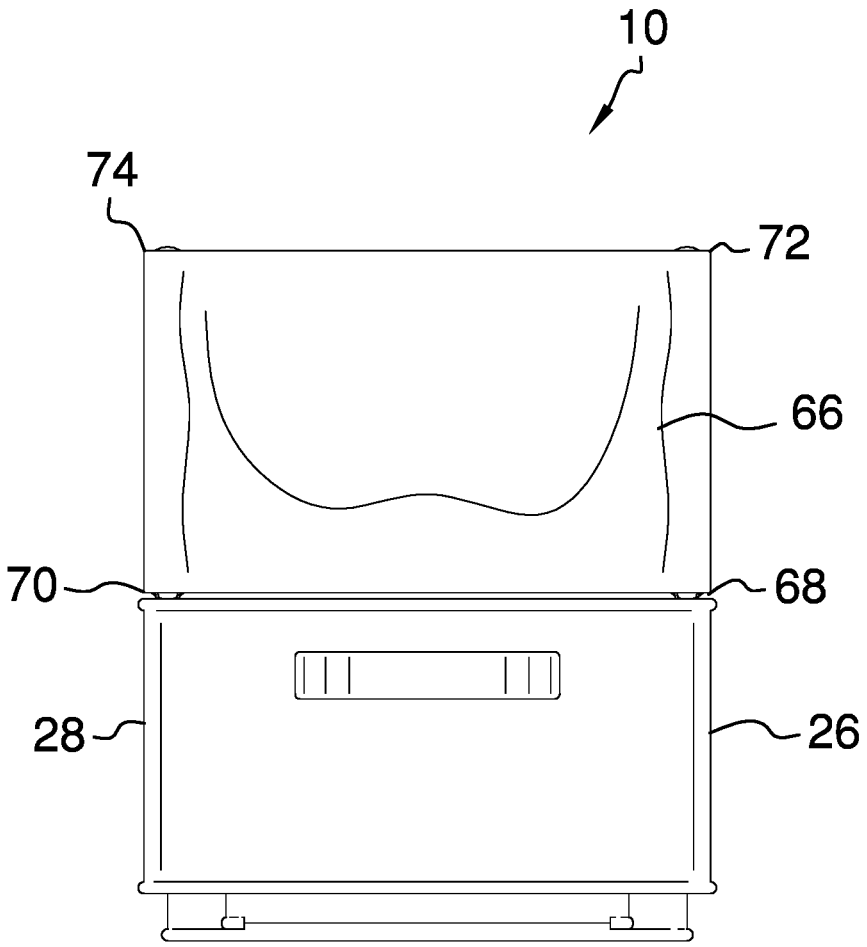
FIG. 3 is a top plan view.
Figure 4:
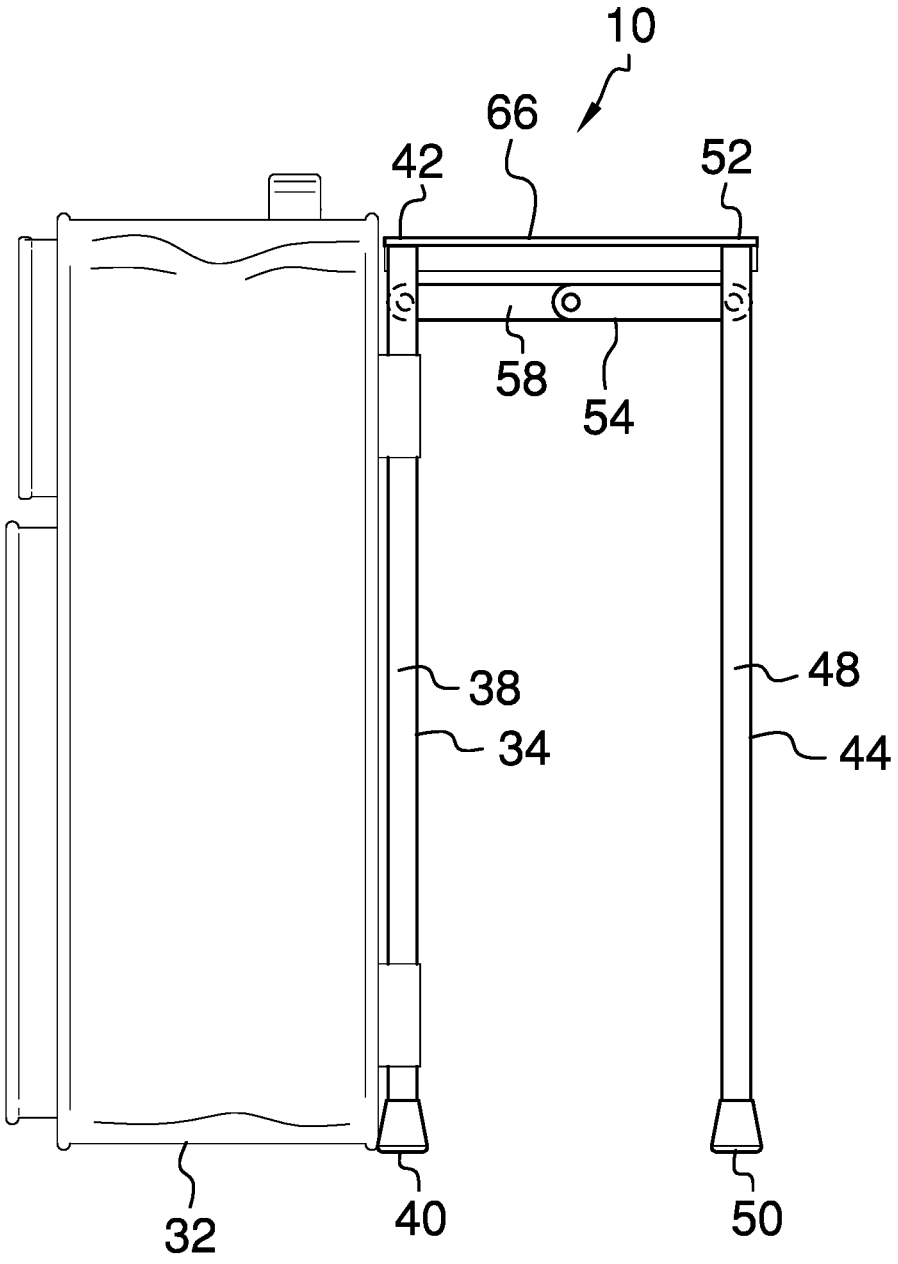
FIG. 4 is a side elevation view showing a pair of outer legs in an extended position.
Figure 5:
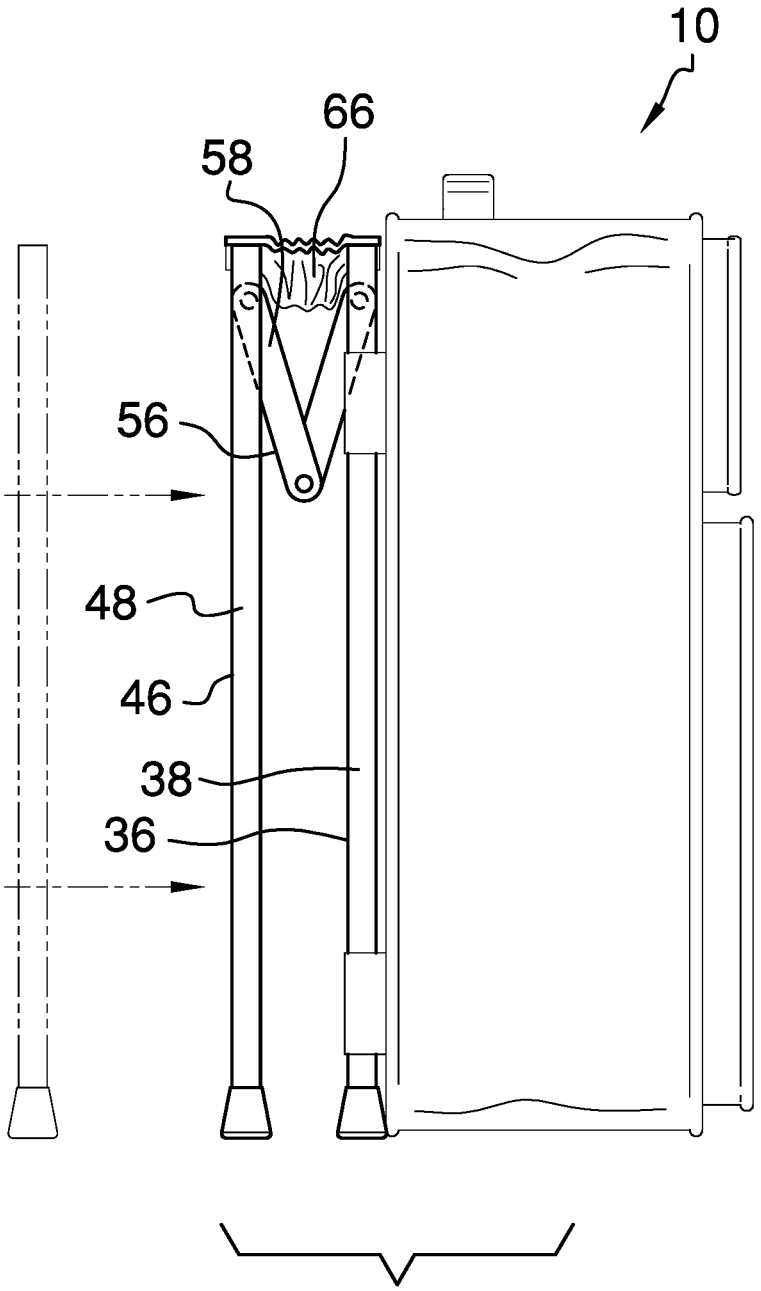
FIG. 5 is a side elevation view showing the pair of outer legs in a retracted position.

With reference now to the drawings, and in particular FIGS. 1 through 5 thereof, an example of the instant suitcase with foldable seat employing the principles and concepts of the present suitcase with foldable seat and generally designated by the reference number 10 will be described.

Referring to FIGS. 1 through 5 the present suitcase with foldable seat 10 is illustrated. The suitcase with foldable seat 10 includes a suitcase 20 having a front side 22, a back side 24, a right side 26, a left side 28, a top side 30, and a bottom side 32. Each of a right inner leg 34 and a left inner leg 36 of a pair of inner legs 38 has a bottom end 40 and a top end 42. The right inner leg 34 is coupled to the back side 24 of the suitcase 20 proximal the right side 26, and the left inner leg 36 is coupled to the back side 24 of the suitcase 20 proximal the left side 28. A right outer leg 44 and a left outer leg 46 of a pair of outer legs 48 has a bottom area 50 and a top area 52. Each of a right support member 54 and a left support member 56 of a pair of horizontal support members 58 has a front end 60, a rear end 62, and a pivotable connection point 64 medially disposed between the front end 60 and the rear end 62. The front end 60 of each of the right support member 54 and the left support member 56 is pivotally attached to each of the right inner leg 34 and the left inner leg 36, respectively, proximal the top end 42. The rear end 62 of each of the right support member 54 and the left support member 56 is pivotally attached to each of the right outer leg 44 and the left outer leg 46, respectively, proximal the top area 52.

The suitcase with foldable seat 10 further includes a single continuous rectangular flexible seat covering 66 having a right front corner 68, a left front corner 70, a right rear corner 72, and a left rear corner 74. The right front corner 68 is disposed on the top end 42 of the right inner leg 34, the left front corner 70 is disposed on the top end 42 of the left inner leg 36, the right rear corner 72 is disposed on the top area 52 of the right outer leg 44, and the left rear corner 74 is disposed on the top area 52 of the left outer leg 46. A length of each of the pair of inner legs 38 and each of the pair of outer legs 48 substantially conforms to a height of the suitcase 20. The pair of outer legs 48 is foldable between a retracted position and an alternate extended position. The pair of outer legs 48 is in the retracted position when the pair of outer legs 48 is disposed immediately adjacent to the pair of inner legs 38, and the pair of outer legs 48 is in the extended position when the pair of outer legs 48 is extended away from the suitcase 20.

What is claimed is:

1. A suitcase with foldable seat comprising:

a suitcase having a front side, a back side, a right side, a left side, a top side, and a bottom side;

a pair of inner legs comprising a right inner leg and a left inner leg, each of the right inner leg and the left inner leg having a bottom end and a top end, wherein the right inner leg is coupled to the back side of the suitcase proximal the right side, and the left inner leg is coupled to the back side of the suitcase proximal the left side;

a pair of outer legs comprising a right outer leg and a left outer leg, each of the right outer leg and the left outer leg having a bottom area and a top area;

a pair of horizontal support members comprising a right support member and a left support member, each of the right support member and the left support member having a front end, a rear end, and a pivotable connection point medially disposed between the front end and the rear end, wherein the front end of each of the right support member and the left support member is pivotally attached to each of the right inner leg and the left inner leg, respectively, proximal the top end, wherein the rear end of each of the right support member and the left support member is pivotally attached to each of the right outer leg and the left outer leg, respectively, proximal the top area; and a single continuous rectangular flexible seat covering having a right front corner, a left front corner, a right rear corner, and a left rear corner, wherein the right front corner is disposed on the top end of the right inner leg, the left front corner is disposed on the top end of the left inner leg, the right rear corner is disposed on the top area of the right outer leg, and the left rear corner is disposed on the top area of the left outer leg;

wherein a length of each of the pair of inner legs and each of the pair of outer legs substantially conforms to a height of the suitcase;

wherein the pair of outer legs is foldable between a retracted position and an alternate extended position;

wherein the pair of outer legs is in the retracted position when the pair of outer legs is disposed immediately adjacent to the pair of inner legs;

wherein the pair of outer legs is in the extended position when the pair of outer legs is extended away from the suitcase.

2. The suitcase with foldable seat of claim 1 wherein the seat covering is a mesh material.

3. The suitcase with foldable seat of claim 1 wherein the seat covering is leather.

* * * * *